US005560382A

United States Patent [19]

Wagner

[11] Patent Number: 5,560,382

[45] Date of Patent: Oct. 1, 1996

[54] AIR CUSHION CRUTCH PAD

[76] Inventor: James A. Wagner, 185 Frontage Rd., Dayton, Nev. 89403

[21] Appl. No.: 435,610

[22] Filed: May 5, 1995

[51] Int. Cl.[6] ..... A61H 3/02

[52] U.S. Cl. ..... 135/73

[58] Field of Search ..... 135/68, 72, 73

[56] References Cited

U.S. PATENT DOCUMENTS

| | | | |
|---|---|---|---|
| 563,358 | 7/1896 | Burdick | 135/73 |
| 736,072 | 8/1903 | Cole | 135/73 |
| 1,232,057 | 7/1917 | Lineback | 135/73 |
| 1,247,143 | 11/1917 | Pennington | 135/73 |
| 1,401,305 | 12/1921 | Beecroft | 135/73 |
| 1,442,518 | 1/1923 | Bowers | 135/73 X |
| 1,565,582 | 12/1925 | Moore | 135/73 |
| 1,673,609 | 6/1928 | Weis | 135/73 |
| 2,037,015 | 4/1936 | Fallon | 135/73 |

*Primary Examiner*—Lanna Mai
*Attorney, Agent, or Firm*—Walter A. Hackler

[57] ABSTRACT

An air cushion crutch pad generally includes a sealed hollow chamber having an air cushion therein, and a cavity which provides means for removably mounting the crutch pad to a upper cross piece of a crutch. Opposing sidewalls of the sealed hollow chamber include rounded upper portions and straight vertical lower portions. A line of inflection provides means for controlling compression of the sealed hollow chamber. A rib, dividing the sealed hollw chamber from the cavity, provides means for stabilizing the sidewalls to prevent collapse thereof. The air cushion crutch pad may be unitary in structure and made of a rubberlike material.

8 Claims, 2 Drawing Sheets

AIR CUSHION CRUTCH PAD

The present invention generally relates to crutch pads and specifically relates to an air cushion crutch pad.

Conventional crutch pads, though intended to reduce soreness associated with use of crutches to aid walking, are frequently a source of discomfort. Presently available crutch pads, typically made of foam rubber, are designed to provide a cushion between a solid upper cross piece, or head, of a crutch and the underarm area of a user. Although initially a new crutch pad will provide some degree of cushioning, after continuous use the crutch pad becomes compressed and loses resiliency. Furthermore, the crutch pad may quickly become worn and compressed in only specific areas of the pad, resulting in unbalanced and ineffective support. Loss of resiliency and uneven wear of. a crutch pad often necessitates the purchase of a new crutch pad as a replacement. For a person who is constrained to walk with the aid of crutches for an extended period of time, replacing crutch pads is highly inconvenient and costly.

A continuous pivoting of the body weight of a user, resulting from the natural walking motion with the use of crutches, causes a constant striking of the crutch head with the front and back of the user's underarm area. The walking motion thus causes continuous jarring, rubbing and abrasion of the underarm area with every step. Unfortunately, conventional foam rubber and fabric covered crutch pads tend to be coarse in texture, becoming even more so over time, and this contributes to painful irritation to the user. This abrasive effect, combined with a worn, unyielding crutch pad can be quite uncomfortable for a user, whose only remedy may be to walk less frequently.

The present invention overcomes these and other problems with conventional crutch pads, by providing a durable crutch pad with superior cushion resiliency. Furthermore, the present invention is designed to eliminate chafing and greatly reduce jarring for a user of crutches.

SUMMARY OF THE INVENTION

An air filled crutch pad generally includes a sealed, hollow air chamber that provides a soft, flexible and resilient cushion between a crutch head, underarm area and adjacent ribcage of a crutch user. A cavity, adjacent the sealed hollow chamber, provides a means for receiving the head, or upper cross piece, of a crutch such that the crutch pad may be removably mounted thereto.

The sealed hollow chamber preferably includes a convex. upper surface in order to enhance user comfort by providing support to both the front and back sides of a user's underarm area.

In addition, the sealed hollow chamber includes a lower surface which has a conformal relationship with the upper surface such that the sealed hollow chamber has a uniform depth throughout. This feature enhances comfort to a user by providing an even distribution of force to the user's underarm area and eliminating weak points which could contribute to collapse of the air cushion.

The sealed hollow chamber further includes opposing sidewalls, each sidewall having a straight vertical lower portion and a rounded upper portion. The upper portions of the sidewalls merge at the top of the crutch pad to form a smooth rounded upper surface that enhances user comfort by eliminating chafing of the user's skin.

Preferably, a line of inflection, for example, dividing each straight lower portion from each rounded upper portion, provides means for controlling compression of the sealed hollow chamber. A rib member, disposed between the sealed hollow chamber and the cavity, provides means for stabilizing the sidewalls of the sealed follow chamber in order to prevent collapse of the sidewalls when the sealed hollow chamber is compressed.

The crutch pad is preferably unitary in structure and made of natural or synthetic rubber, elastomer, or other like material that can retain air within the sealed hollow chamber after the material is cured. The rubberlike material of the lower portion ensures that the position of the crutch pad will remain fixed with respect to the cross piece and resist slipping during use. Furthermore, a lip portion, along a lower edge of the cavity may be provided in order to effectively hook the crutch pad to the cross. piece.

By utilizing a variety of molds in the manufacturing process, different sizes of sealed hollow chambers may be offered in order to accommodate a variety of individuals according to the amount of support required.

BRIEF DESCRIPTION OF THE DRAWINGS

The advantages and features of the present invention will be better understood by the following description when considered in conjunction with the accompanying drawings in which.

DETAILED DESCRIPTION

Figure 1:
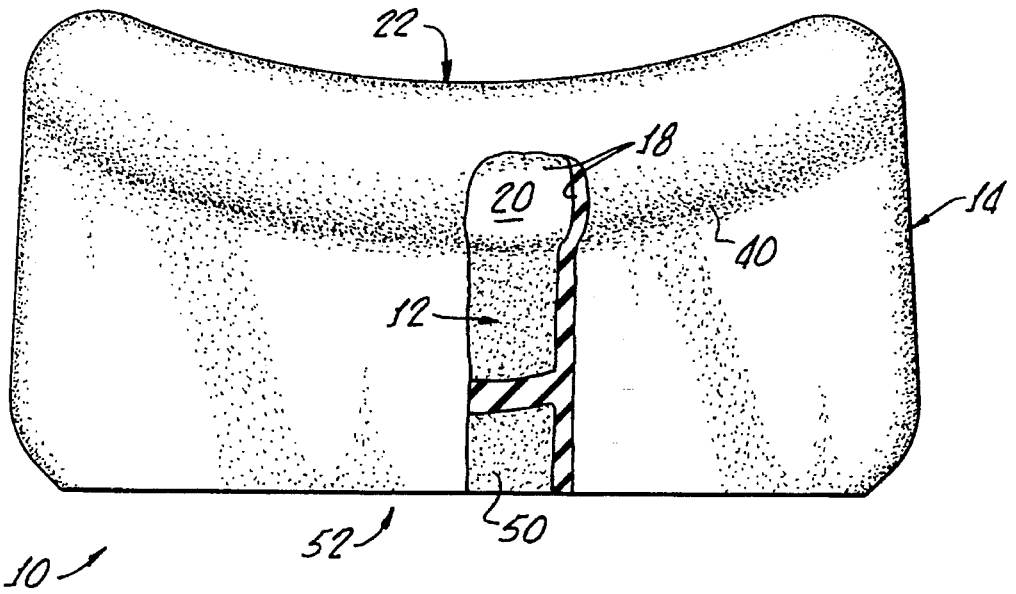
FIG. 1 shows a partially broken away perspective view of an embodiment of the present invention.

Turning now to FIG. 1, a air cushion crutch pad 10 in accordance with the present invention is shown. Generally, the crutch pad 10 comprises a sealed hollow chamber 12 which provides resilient cushioning between a upper cross piece, or head, of a conventional crutch (not shown in FIG. 1) and an underarm area and ribcage of a user (not shown in the Figures). The air cushion crutch pad 10 further comprises receiving means 14 adjacent the sealed hollow chamber 12, for removably mounting the crutch pad 10 to the upper cross piece.

The sealed hollow chamber 12 includes two opposing. sidewalls 18 which enclose a flexible air cushion 20. The air cushion crutch pad 10 is designed to provide long lasting resiliency and uniform distribution of support even after continuous use, as will be discussed in greater detail hereinafter.

Figure 2:
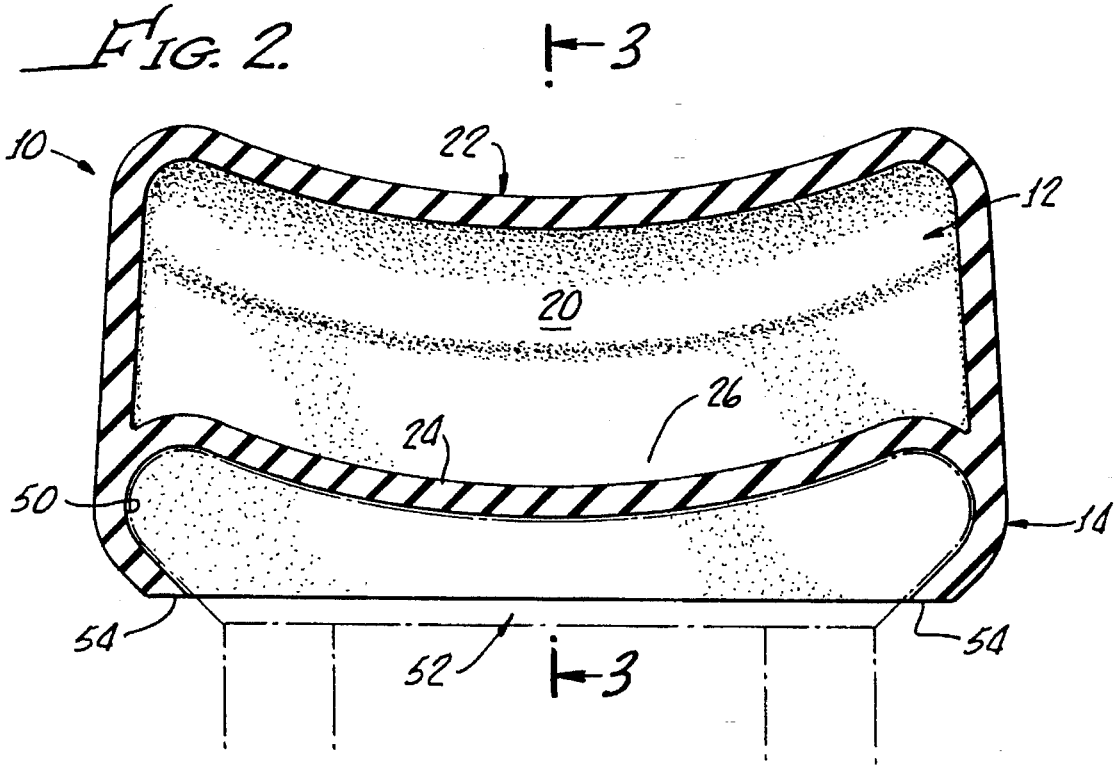
FIG. 2 shows a cross sectional view of the embodiment shown in FIG. 1.
Figure 3:
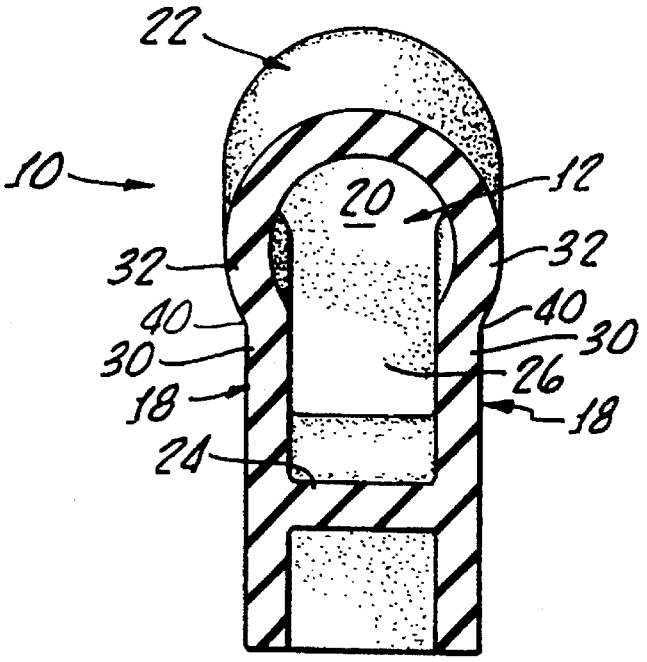
FIG. 3 shows a sectional view of the embodiment of FIG. 1 taken along line 3—3 of FIG. 2.

Referring now to FIG. 2, the sealed hollow chamber 12 may include a convex upper surface 22, as shown, in order to provide comfortable support to the front and back areas of a user's underarm. Turning as well to FIG. 3, a rib member 24 defines a lower surface 26 of the sealed hollow chamber 12 and also provides means for stabilizing the sidewalls 18.

Preferably, the lower surface 26 has a conformal relationship with the upper surface. Thus, for example, the upper surface 22 and the lower surface 26 may both be convex in curvature as shown in FIG. 2. This provides that the sealed hollow chamber 12 will have a uniform depth throughout, thus enhancing the stability of the air cushion 20. Stability is enhanced further by the structure of the sidewalls 18. This can be more clearly understood with reference to FIGS. 3 and 4 which show that each sidewall 18 comprises a vertical straight lower portion 30 and a rounded upper portion 32. The rounded upper portions 32 merge to form the upper surface 22 of the sealed hollow chamber 12.

Figure 4:
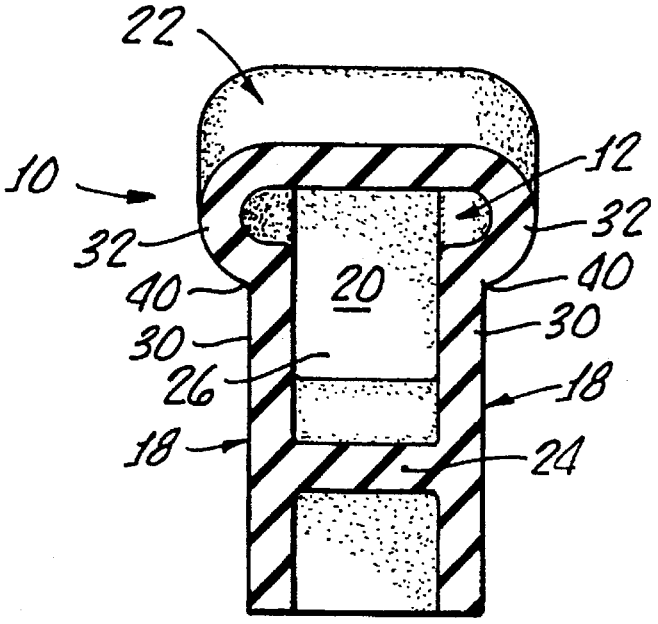
FIG. 4 shows a cross sectional view of the embodiment of FIG. 1, with the sealed hollow chamber being compressed.

Furthermore, a line of inflection 40 (which is also shown in FIG. 1) provides means for controlling compression of the sealed hollow chamber 12. FIG. 4 shows a cross sectional view of the crutch pad 10 during compression thereof. The sealed hollow chamber flexes inward at the line of inflection 40 such that rounded upper portions 32 of the sidewalls 18 yield to the compression and the lower straight portions 30 remain supportive. Thus, during compression, the sealed hollow chamber 12, maintains sufficient depth for cushioning the underarm area. The rib member 24 provides means for stabilizing the sidewalls 18 during compression by bolstering the sealed hollow chamber 12 in order to prevent collapse thereof.

Referring back to FIGS. 1 and 2, the receiving means 14 may comprise a cavity 50 sized for fitting a conventional crutch cross piece (shown in phantom line in FIG. 2). The cavity 50 is open on one end 52 such that the cross piece may be removably inserted therein. Notably, a crutch pad 10 in accordance with the present invention does not require the use of adhesives or the like for providing connection to the crutch cross piece. The cavity 50 is contoured to grip the crutch cross piece. In addition, an inward curving lip portion 54 of said cavity 50 may be provided for additional security.

The sealed hollow chamber 12 and the receiving means 14 may be a single unit in structure. The crutch pad 10 may be entirely made of molded rubber-like material, such as natural or synthetic rubber, elastomer, or any other material suitable for retaining an air chamber once the material is cured.

This unitary molded structure enables the crutch pad to be easily cleaned by washing in hot soapy water. If sterilization is necessary or desired the entire crutch pad may be immersed in boiling water or antiseptic. Because the rubberlike material of the crutch pad is non-absorptive and non-porous, it resists absorption of dirt and odors thus retaining a tidy appearance and promoting user hygiene. Furthermore, the rubberlike material enhances the gripping action of the receiving means.

Notably, as long as the sealed hollow chamber 12 is not punctured or otherwise caused to rupture, the air cushion 20 will provide long lasting resiliency and comfort to a user. As the air cushion 20 is essentially fluid, the crutch pad 10 tends to move in harmony with a user, thus greatly reducing the jarring effect often attributed to conventional crutch pads.

Importantly, the present invention, which is easily manufactured by conventional rubber molding techniques, can be formed for various shapes of crutch cross pieces. Furthermore, through the use of various molds, different shapes or sizes of sealed hollow chambers may be constructed in order to suit a variety of users. For example, different sizes of air chambers may be made available in order to accommodate various individuals according to a user's weight.

Although there has been hereinabove described a particular embodiment of an air cushion crutch pad in accordance with the present invention for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A crutch pad comprising:

resilient means, including a sealed hollow chamber, having opposing sidewalls, for providing flexible cushioning between a cross piece of a crutch and an underarm and ribcage of a user, said sealed hollow chamber enclosing an air cushion and including a lower surface and a convex upper surface, said lower surface having a conformed relationship with the upper surface;

means for controlling compression of the sealed hollow chamber, the means for controlling compression including a line of inflection along the opposing sidewalls, each sidewall of the sealed hollow chamber including a straight lower portion and a rounded upper portion, and wherein said line of inflection divides each lower portion from each upper portion; and receiving means, adjacent said resilient means, for removably mounting the crutch pad to the cross piece.

2. The crutch pad according to claim 1 wherein the resilient means and the receiving means are both formed of the same material and are unitary in structure.

3. The crutch pad according to claim 2 wherein the material is a rubber-like material.

4. The crutch pad according to claim 1 wherein the receiving means includes a cavity adapted for securing the crutch pad to the cross piece.

5. The crutch pad according to claim 4 wherein the receiving means further includes a lip portion of said cavity.

6. The crutch pad according to claim 4 further including means for stabilizing the sidewalls of the sealed hollow chamber in order to prevent collapse of the sidewalls when the sealed hollow chamber is compressed.

7. The crutch pad according to claim 6 wherein the means for stabilizing comprises a rib member, said rib member disposed within the crutch pad between the sealed hollow chamber and the cavity.

8. A crutch pad comprising:

resilient means, comprising a sealed hollow chamber, for providing flexible cushioning between a cross piece of a crutch and an underarm and a ribcage of a user, said sealed hollow chamber including opposing sidewalls wherein each sidewall includes a straight lower portion and a rounded upper portion, a convex upper surface, and a lower surface having a conformal relationship with said convex upper surface such that the sealed hollow chamber has a uniform depth throughout;

receiving means, comprising a cavity having a lip portion, for removably mounting the crutch pad to the cross piece, said resilient means and said receiving means both being unitary in structure and made of a rubberlike material;

means, including a line of inflection dividing the straight lower portion from the rounded upper portion of each sidewall, for controlling compression of the sealed hollow chamber; and means, including a rib disposed within the crutch pad between the sealed hollow chamber and the cavity, for stabilizing the sidewalls of the sealed hollow chamber in order to prevent collapse thereof when the sealed hollow chamber is compressed.

* * * * *